US005738696A

United States Patent [19]

Wu

[11] Patent Number: 5,738,696

[45] Date of Patent: Apr. 14, 1998

[54] METHOD FOR MAKING HIGH PERMEABILITY GRINDING WHEELS

[75] Inventor: Mianxue Wu, Worcester, Mass.

[73] Assignee: Norton Company, Worcester, Mass.

[21] Appl. No.: 687,816

[22] Filed: Jul. 26, 1996

[51] Int. Cl.[6] ..... B24D 3/00

[52] U.S. Cl. ..... 51/296; 51/293

[58] Field of Search ..... 51/293, 296

[56] References Cited

U.S. PATENT DOCUMENTS

| | | | |
|---|---|---|---|
| 3,273,984 | 9/1966 | Nelson | 51/296 |
| 3,537,121 | 11/1970 | McAvoy | 51/295 |
| 3,547,608 | 12/1970 | Kitazawa | 51/295 |
| 4,401,442 | 8/1983 | Oide | 51/297 |
| 5,009,676 | 4/1991 | Rue et al. | 51/309 |
| 5,035,723 | 7/1991 | Kalinowski et al. | 51/309 |
| 5,037,452 | 8/1991 | Gary et al. | 51/293 |
| 5,129,919 | 7/1992 | Kalinowski et al. | 51/309 |
| 5,185,012 | 2/1993 | Kelly | 51/295 |
| 5,203,886 | 4/1993 | Sheldon et al. | 51/309 |
| 5,221,294 | 6/1993 | Carman et al. | 51/296 |
| 5,244,477 | 9/1993 | Rue et al. | 51/293 |
| 5,429,648 | 7/1995 | Wu | 51/296 |
| 5,431,705 | 7/1995 | Wood | 51/309 |

FOREIGN PATENT DOCUMENTS

| | | | |
|---|---|---|---|
| 1175665 | 10/1984 | Canada | B24D 3/26 |
| 86-209880 | 9/1986 | Japan | B24D 7/06 |
| 91-161273 | 7/1991 | Japan | B24D 3/18 |
| 91-281174 | 12/1991 | Japan | B24D 3/18 |

*Primary Examiner*—Deborah Jones
*Attorney, Agent, or Firm*—Mary E. Porter

[57] ABSTRACT

An efficient method for manufacturing bonded abrasive articles comprises the use of elongated abrasive grain having a length to cross-sectional width aspect ratio of at least 5:1 to yield abrasive articles which are highly permeable to the passage of fluids. A method for measuring permeability is provided. The abrasive articles are used to carry out soft grinding and deep cut grinding operations. The permeable abrasive articles provide an open structure of pores and channels permitting the passage of fluid through the abrasive article and the removal of swarf from the workpiece during grinding operations.

28 Claims, No Drawings

METHOD FOR MAKING HIGH PERMEABILITY GRINDING WHEELS

BACKGROUND OF THE INVENTION

The invention relates to a process for making an abrasive article by utilizing elongated abrasive grains to achieve high-permeability abrasive articles useful in high-performance grinding applications. The abrasive articles have unprecedented interconnected porosity, openness and grinding performance.

Pores, especially those of which are interconnected in an abrasive tool, play a critical role in two respects. Pores provide access to grinding fluids, such as coolants for transferring the heat generated during grinding to keep the grinding environment constantly cool, and lubricants for reducing the friction between the moving abrasive grains and the workpiece surface and increasing the ratio of cutting to tribological effects. The fluids and lubricants minimize the metallurgical damage (e.g., burn) and maximize the abrasive tool life. This is particularly important in deep cut and modern precision processes (e.g., creep feed grinding) for high efficiency grinding where a large amount of material is removed in one deep grinding pass without sacrificing the accuracy of the workpiece dimension. It has been discovered that grinding performance cannot be predicted only on the basis of porosity as a volume percentage of the abrasive tool. Instead, the structural openness (i.e., the pore interconnection) of the wheel, quantified by its permeability to fluids (air, coolant, lubricant, etc.), determines the abrasive tool performance.

Permeability also permits the clearance of material (e.g., metal chips or swarf) removed from an object being ground. Debris clearance is essential when the workpiece material being ground is difficult to machine or gummy (such as aluminum or some alloys), producing long metal chips. Loading of the grinding surface of the wheel occurs readily and the grinding operation becomes difficult in the absence of wheel permeability.

To make an abrasive tool meeting porosity requirements, a number of methods have been tried over the years.

U.S. Pat. No. 5,221,294 of Carman, et al., discloses abrasive wheels having 5–65% void volume achieved by utilizing a one step process in which an organic pore-forming structure is burnt out during cure to yield a reticulated abrasive structure.

JP Pat. No. -A-91-161273 of Gotoh, et al., discloses abrasive articles having large volume pores, each pore having a diameter of 1–10 times the average diameter of the abrasive grain used in the article. The pores are created using materials which burn out during cure.

JP Pat. No. -A-91-281174 of Satoh, et al., discloses abrasive articles having large volume pores, each pore having a diameter of at least 10 times the average diameter of the abrasive grain used in the article. A porosity of 50% by volume is achieved by burn out of organic pore inducing materials during cure.

U.S. Pat. No. 5,037,452 of Gary, et al., discloses an index useful to define the structural strength needed to form very porous wheels.

U.S. Pat. No. 5,203,886 of Sheldon, et al., discloses a combination of organic pore inducers (e.g., walnut shells) and closed cell pore inducers (e.g., bubble alumina) useful in making high porosity vitrified bond abrasive wheels. A "natural or residual porosity" (calculated to be about 28–53%) is described as one part of the total porosity of the abrasive wheel.

U.S. Pat. No. 5,244,477 of Rue, et al., discloses filamentary abrasive particles used in conjunction with pore inducers to produce abrasive articles containing 0–73%, by volume, pores.

U.S. Pat. No. 3,273,984 of Nelson discloses an abrasive article containing an organic or resinous bond and at least 30%, by volume, abrasive grain, and, at most, 68%, by volume, porosity.

U.S. Pat. No. 5,429,648 of Wu discloses vitrified abrasive wheels containing an organic pore inducer which is burned out to form an abrasive article having 35–65%, by volume, porosity.

These and other, similar efforts fall into two major categories, neither of which practically meet the requirements for a high permeability abrasive tool.

The first category is burn-out methods. Pore structure is created by addition of organic pore inducing media (such as walnut shells) in the wheel mixing stage. These media thermally decompose upon firing of the green body of abrasive tool, leaving voids or pores in the cured abrasive tool. Drawbacks of this method include: moisture absorption during storage of the pore inducer; mixing inconsistency and mixing separation, partially due to moisture, and partially due to the density difference between the abrasive grain and pore inducer; molding thickness growth or "springback" due to time-dependent strain release on the pore inducer upon unloading the mold, causing uncontrollable dimension of the abrasive tool; incompleteness of burn-out of pore inducer or "coring"/"blackening" of an fired abrasive article if either the heating rate is not slow enough or the softening point of a vitrified bonding agent is not high enough; and air borne emissions and odors when the pore inducer is thermally decomposed, often causing a negative environmental impact.

The second category is the closed cell or bubble method. Introducing materials, such as bubble alumina, into an abrasive tool induces porosity without a burnout step. However, the pores created by the bubbles are internal and closed, so the pore structure is not permeable to the passage of coolant and lubricant, and the pore size typically is not large enough for metal chip clearance.

To overcome these drawbacks, and yet preserve and maximize the respective benefits of each pore inducing method, the invention takes advantage of the poor packing characteristics of elongated or fiber-like abrasive grains having a length to diameter aspect ratio (L/D) of at least 5:1 to increase wheel permeability as well as porosity. Selected fillers, having a similar filamentary form may be used or in combination with, the filamentary abrasive grain.

When used in abrasive article compositions, the elongated abrasive grains yield high-porosity, high-permeability and high-performance abrasive tools after firing or curing, without the drawbacks of the burn outland pore inducer methods.

SUMMARY OF THE INVENTION

The invention is a method for making an abrasive article, comprising at least about 55% to 80%, by volume, interconnected porosity, and abrasive grain and bond in amounts effective for grinding; comprising the steps a) blending a mixture comprising elongated abrasive grain having a length to cross-sectional width aspect ratio of at least 5:1 and vitrified bond to form an abrasive mix;

b) pressing the abrasive mix in a mold to form a green abrasive article; and c) firing the green abrasive article at 600° to 1300° under conditions effective to cure the green abrasive article and form the abrasive article.

whereby the firing step is carried out over a period of time which is at least one-half of the time needed under the same conditions to fire an equivalent green abrasive article which does not contain the elongated abrasive grain, and the abrasive article has an air permeability measured in cc air/second/inch of water of at least 0.44 times the cross-sectional width of the abrasive grain.

The invention also includes a method for making an abrasive article, comprising from about 40% to less than 55%, by volume, interconnected porosity, and abrasive grain and bond in amounts effective for grinding; comprising the steps a) blending a mixture comprising elongated abrasive grain having a length to cross-sectional width aspect ratio of at least 5:1 and vitrified bond to form an abrasive mix;

b) pressing the abrasive mix in a mold to form a green abrasive article; and c) firing the green abrasive article at 600° to 1300° C. under conditions effective to cure the green abrasive article and form the abrasive article, whereby the firing step is carried out over a period of time which is at least one-half of the time needed under the same conditions to fire an equivalent green abrasive article which does not contain the elongated abrasive grain, and the abrasive article has an air permeability measured in cc air/second/inch of water of at least 0.22 times the cross-sectional width of the abrasive grain.

By employing this method, the abrasive article following cure has less than 3%, by volume, variation in size relative to the green abrasive article, and the green abrasive article is substantially free of springback following pressing.

DETAILED DESCRIPTION OF THE INVENTION

The abrasive article made according to the invention comprises effective amounts of abrasive grain and bond needed for grinding operations and, optionally, fillers, lubricants or other components. The abrasive articles preferably contain the maximum volume of permeable porosity which can be achieved while retaining sufficient structural strength to withstand grinding forces. Abrasive articles include tools such as grinding wheels, hones and wheel segments as well as other forms of bonded abrasive grains designed to provide abrasion to a workpiece.

The abrasive article may comprise about 40 to 80%, preferably 45 to 75% and most preferably 50 to 70%, by volume, interconnected porosity. Interconnected porosity is the porosity of the abrasive article consisting of the interstices between particles of bonded abrasive grain which are open to the flow of a fluid.

The balance of the volume, 20 to 60%, is abrasive grain and bond in a volumetric ratio of about 20:1 to 1:1 grain to bond. These amounts are effective for grinding, with higher amounts of bond and grain required for larger abrasive wheels and for formulations containing organic bonds rather than vitrified bonds. In a preferred embodiment, the abrasive articles are formed with a vitrified bond and comprise 15 to 40% abrasive grain and 3 to 15% bond.

In order to exhibit the observed significant improvements in wheel life, grinding performance and workpiece surface quality, the abrasive articles made according to the invention must have a minimum permeability capacity for permitting the free flow of fluid through the abrasive article. As used herein, the permeability of an abrasive tool is Q/P, where Q means flow rate expressed as cc of air flow, and P means differential pressure. Q/P is the pressure differential measured between the abrasive tool structure and the atmosphere at a given flow rate of a fluid (e.g., air). This relative permeability Q/P is proportional to the product of the pore volume and the square of the pore size. Larger pore sizes are preferred. Pore geometry and abrasive grain size or grit are other factors affecting Q/P, with larger grit size yielding higher relative permeability. Q/P is measured using the apparatus and method described in Example 6, below.

Thus, for an abrasive tool having about 55% to 80% porosity in a vitrified bond, using an abrasive grain grit size of 80 to 120 grit (132–194 micrometers) in cross-sectional width, an air permeability of at least 40 cc/second/inch of water is required to yield the benefits of the invention. For an abrasive grain grit size greater than 80 grit (194 micrometers), a permeability of at least 50 cc/second/inch of water is required.

The relationship between permeability and grit size for 55% to 80% porosity may be expressed by the following equation: minimum permeability=0.44×cross-sectional width of the abrasive grain. A cross-sectional width of at least 220 grit (70 micrometers) is preferred.

For an abrasive tool having from about 40% to less than about 55% porosity in a vitrified bond, using an abrasive grain size of 80 to 120 grit (132–194 micrometers), an air permeability of at least 29 cc/second/inch of water is required to yield the benefits of the invention. For an abrasive grit size greater than 80 grit (194 micrometers), a permeability of at least 42 cc/second/inch of water is required.

The relationship between permeability and grit size for from about 40% to less than 55% porosity may be expressed by the following equation: minimum permeability=0.22 ×cross-sectional width of the abrasive grain.

Similar relative permeability limits for other grit sizes, bond types and porosity levels may be determined by the practitioner by applying these relationships and D'Arcy's Law to empirical data for a given type of abrasive article.

Smaller cross-sectional width grain requires the use of filament spacers (e.g., bubble alumina) to maintain permeability during molding and firing steps. Larger grit sizes may be used. The only limitation on increasing grit size is that the size be appropriate for the workpiece, grinding machine, wheel composition and geometry, surface finish and other, variable elements which are selected and implemented by the practitioner in accordance with the requirements of a particular grinding operation.

The enhanced permeability and improved grinding performance of the invention results from the creation of a unique, stable, interconnecting porosity defined by a matrix of fibrous particles ("the fibers"). The fibers may consist of abrasive grain or a combination of elongated abrasive grain and fibrous fillers. The fibers are mixed with the bond components and other abrasive tool components, then pressed and cured or fired to form the tool.

If the particles are arranged even more loosely by another method, such as by addition of minor amounts of pore inducer to further separate fiber grain particles, even higher porosities can be achieved. Upon firing, the article comprised of organic pore inducer particles may shrink back to result in an article having a smaller dimension when the pore inducer is thermally decomposed because the particles have to interconnect for integrity of the article. Thus, organic pore inducers are most preferably avoided, and, if used, are limited to less than 5%, by volume, of the wheel. The shrunk final dimension after firing of the abrasive tool and the resultant permeability created is a function of the aspect ratio of the fiber particles. The higher the L/D is, the higher the permeability of the packed array of fibers can be.

It is believed that elongated grain creates structural anisotropy in the abrasive wheels and this increases the actual number of cutting points of the wheels compared with granular abrasive grain. Therefore, the wheels are sharper. In addition, there are more bond posts created per grain with an elongated grain. As a result, the bond is stronger and the grain has a longer useful life. These effects permit the manufacture of higher porosity, higher permeability wheels, with equal or higher structural strength with an elongated grain, relative to the same grain type having a short L/D.

Any abrasive mix formulation may be used in the method of invention to prepare the abrasive articles herein, provided the mix contains abrasive grain having an aspect ratio of at least 5:1 , and after forming the article and firing it, yields an article having the minimum permeability and interconnected porosity characteristics specified herein.

In a preferred embodiment, the abrasive article comprises a filamentary abrasive grain particle incorporating sintered sol gel alpha alumina based polycrystalline abrasive material, preferably having crystallites that are no larger than 1–2 microns, more preferably less than 0.4 microns in size. Suitable filamentary grain particles are described in U.S. Pat. Nos. 5,244,477 to Rue, et al.; 5,129,919 to Kalinowski, et al.; 5,035,723 to Kalinowski, et al.; and 5,009,676 to Rue, et al., which are hereby incorporated by reference. Other types of polycrystalline alumina abrasive grain having larger crystallites from which filamentary abrasive grain may be obtained and used herein are disclosed in, e.g., U.S. Pat. Nos. 4,314,705 to Weitheiser, et al.; and 5,431,705 to Wood, which are hereby incorporated by reference. Filamentary grain obtained from these sources preferably has a L/D aspect ratio of at least 5:1, preferably 6:1. Various filamentary shapes may be used, including, e.g., straight, curved, corkscrew and bend fibers. In a preferred embodiment, the alumina fibers are hollow shapes.

Any abrasive grain may be used in the articles of the invention, whether or not in filamentary form in combination with a major amount of filamentary grain. Conventional abrasives, including, but not limited to, aluminum oxide, silicon carbide, zirconia-alumina, garnet and emery may be used in a grit size of about 0.5 to 5,000 micrometers, preferably about 2 to 200 micrometers. These abrasives and superabrasives may be used in the form of conventional grit particles or elongated particles having an aspect ratio of at least 5:1. Superabrasives, including, but not limited to, diamond, cubic boron nitride and boron suboxide (as described in U.S. Pat. No. 5,135,892, which is hereby incorporated by reference) may be used in the same grit sizes as conventional abrasive grain.

While any bond normally used in abrasive articles may be employed with the fibrous particles to form a bonded abrasive article, a vitrified bond is preferred for structural strength and for precision grinding purposes. Other bonds known in the art, such as organic, metal and resinous bonds, together with appropriate curing agents, may be used for, e.g., articles having an interconnected porosity of about 40 to 70%.

The abrasive article can include other additives, including but not limited to fillers, preferably as non-spherical shapes, such as filamentary or matted or agglomerated filamentary particles, lubricants and processing adjuncts, such as antistatic agents and temporary binding materials for molding and pressing the articles. As used herein "fillers" excludes pore inducers of the closed cell and organic materials types. The appropriate amounts of these optional abrasive mix components can be readily determined by those skilled in the art.

Suitable fillers include secondary abrasives, solid lubricants, metal powder or particles, ceramic powders, such as silicon carbides, and other fillers known in the art.

The abrasive mixture comprising the filamentary material, bond and other components is mixed and formed using conventional techniques and equipment. The abrasive article may be formed by cold, warm or hot pressing or any process known to those skilled in the art. The abrasive article may be fired by firing processes known in the art and selected for the type and quantity of bond and other components, provided that, in general, as the porosity content increases, the firing time and temperature decreases.

In the method of the invention, for an abrasive wheel comprising (e.g., sol gel alumina) abrasive grain having an aspect ratio of at least 5:1 in a vitrified bond, the firing cycle time may be reduced by one-half of the requirements for the same volume percent interconnected porosity in an abrasive wheel comprising organic pore inducer and no grain or filler having an L/D aspect ratio of at least 5:1. In a preferred embodiment, an abrasive wheel mix comprising, on a volume percentage basis, 30–40% grain (80–120 grit, 6:1 L/D sol gel alumina) 3–15% vitrified bond, 0–5% fillers and 0–0.5% processing aids, is blended in a mixer, then discharged into wheel molds, pressed and then dried at 35% relative humidity and about 43° C. The green pressed wheels are kiln fired by heating for about 4 hours at 1250° C.

This method yields a wheel having a volume percentage porosity equivalent to that obtained utilizing an equal amount of grain, and 5 to 25%, by volume of the green wheel, of organic pore inducer, but having a permeability of 2 to 5 times that of the pore inducer wheel. Such wheels of the prior art are described in detail in U.S. Pat. No. 5,429,648, which is hereby incorporated by reference. In addition, the method is completed at 5 times the rate of the burn out method and in one-half the firing time (utilizing the same kiln, molds and firing temperatures).

Abrasive articles prepared by this method exhibit improved grinding performance, especially in creep feed precision grinding. Such abrasive tools have a longer wheel life, higher G-ratio (ratio of metal removal rate to wheel wear rate) and lower power draw than similar tools prepared from the same abrasive mix but having lower porosity and permeability and/or having the same porosity and lower permeability. The abrasive tools of the invention also yield a better, smoother workpiece surface than conventional tools.

EXAMPLE 1

This example demonstrates the manufacture of grinding wheels using long aspect ratio, seeded sol-gel alumina (TARGA™) grains obtained from Norton Company (Worcester, Mass.) with an average L/D ~7.5, without added pore inducer. The following Table 1 lists the mixing formulations:

TABLE 1

Composition of Raw Material Ingredients for Wheels 1–3

| Ingredient | Parts by Weight (1) | (2) | (3) |
|---|---|---|---|
| Abrasive grain* | 100 | 100 | 100 |
| Pore inducer | 0 | 0 | 0 |
| Dextrin | 3.0 | 3.0 | 3.0 |
| Aroma Glue | 4.3 | 2.8 | 1.8 |
| Ethylene glycol | 0.3 | 0.2 | 0.2 |
| Vitrified bonding agent | 30.1 | 17.1 | 8.4 |

*(120 grit, ~132 × 132 × 990 μm)

For each grinding wheel, the mix was prepared according to the above formulations and sequences in a Hobart® mixer. Each ingredient was added sequentially and was mixed with the previous added ingredients for about 1–2 minutes after each addition. After mixing, the mixed material was placed into a 7.6 cm (3 inch) or 12.7 cm (5 inch) diameter steel mold and was cold pressed in a hydraulic molding press for 10–20 seconds resulting in 1.59 cm (⅝ inch) thick disk-like wheels with a hole of 2.22 cm (⅞ inch). The total volume (diameter, hole and thickness) as-molded wheel and total weight of ingredients were predetermined by the desired and calculated final density and porosity of such a grinding wheel upon firing. After the pressure was removed from the pressed wheels, the wheel was taken away manually from the mold onto a batt for drying 3–4 hours before firing in a kiln, at a heating rate of 50° C./hour from 25° C. to the maximum 900° C., where the wheel was held for 8 hours before it was naturally cooled down to room temperature in the kiln.

The density of the wheel after firing was examined for any deviation from the calculated density. Porosity was determined from the density measurements, as the ratio of the densities of abrasive grain and vitrified bonding agent had been known before batching. The porosities of three abrasive articles were 51%, 58%, and 62%, by volume, respectively.

EXAMPLE 2

This example illustrates the manufacture of two wheels using TARGA™ grains with an L/D ~30, without any pore inducer, for extremely high porosity grinding wheels.

The following Table 2 list the mixing formulations. After molding and firing, as in Example 1, vitrified grinding wheels with porosities (4) 77% and (5) 80%, by volume, were obtained.

TABLE 2

Composition of raw material ingredients for wheels 4–5

| Ingredient | Parts by Weight (4) | (5) |
|---|---|---|
| Abrasive grain* | 100 | 100 |
| Pore inducer | 0 | 0 |
| Dextrin | 2.7 | 2.7 |
| Aroma Glue | 3.9 | 3.4 |
| Ethylene glycol | 0.3 | 0.2 |
| Vitrified bonding agent | 38.7 | 24.2 |

*(120 grit, ~135 × 80 × 3600 μm)

EXAMPLE 3

This example demonstrates that this process can produce commercial scale abrasive tools, i.e., 500 mm (20 inch) in diameter. Three large wheels (20×1×8 inch, or 500×25×200 mm) were made using long TARGA™ grains having an average L/D ~6.14, 5.85, 7.6, respectively, without added pore inducer, for commercial scale creep-feed grinding wheels.

The following Table 3 lists the mixing formulations. At molding stage, the maximum springback was less than 0.2% (or 0.002 inch or 50 μm, compared to the grain thickness of 194 μm) of the wheel thickness, far below grinding wheels of the same specifications containing pore inducer. The molding thickness was very uniform from location to location, not exceeding 0.4% (or 0.004 inch or 100 μm) for the maximum variation. After molding, each grinding wheel was lifted by air-ring from the wheel edge onto a batt for overnight drying in a humidity-controlled room. Each wheel was fired in a kiln with a heating rate of slight slower than 50° C./hour and holding temperature of 900° C. for 8 hours, followed by programmed cooling down to room temperature in the kiln.

After firing, these three vitrified grinding wheels were determined to have porosities: (6) 54%, (7) 54% and (8) 58%, by volume. No cracking was found in these wheels and the shrinkage from molded volume to fired volume was equal to or less than observed in commercial grinding wheels made with bubble alumina to provide porosity to the structure. The maximum imbalances in these three grinding wheels were 13.6 g (0.48 oz), 7.38 g (0.26 oz), and 11.08 g (0.39 oz), respectively, i.e., only 0.1%–0.2% of the total wheel weight. The imbalance data were far below the upper limit at which a balancing adjustment is needed. These results suggest significant advantages of the present method in high-porosity wheel quality consistency in manufacturing relative to conventional wheels.

TABLE 3

Composition of Raw Material Ingredients for Wheels 6–8

| Ingredient | Parts by Weight (6) | (7) | (8) |
|---|---|---|---|
| Abrasive grain* | 100 | 100 | 100 |
| Pore inducer | 0 | 0 | 0 |
| Dextrin | 4.0 | 4.5 | 4.5 |
| Aroma Glue | 2.3 | 3.4 | 2.4 |
| Ethylene glycol | 0.2 | 0.2 | 0.2 |
| Vitrified bonding agent | 11.5 | 20.4 | 12.7 |

*(80 grit, ~194 × 194 × [194 × 6.14] μm)

EXAMPLE 4

(I) Abrasive wheels comprising an equivalent volume percentage open porosity were manufactured on commercial scale equipment from the following mixes to compare the productivity of automatic pressing and molding equipment using mixes containing pore inducer to that of the invention mixes without pore inducer.

Wheel 9 Mix Formulations

| Ingredient | Percent by Weight (A) Invention | (B) Conventional |
|---|---|---|
| Abrasive grain* | 100 | 100 |
| Pore inducer (walnut shell) | 0 | 8.0 |
| Dextrin | 3.0 | 3.0 |
| Aroma Glue | 0.77 | 5.97 |

-continued

Wheel 9 Mix Formulations

| Ingredient | Percent by Weight (A) Invention | (B) Conventional |
|---|---|---|
| Ethylene glycol | 0 | 0.2 |
| Water | 1.46 | 0 |
| Drying agent | 0.53 | 0 |
| Vitrified bonding agent | 17.91 | 18.45 |

*(A) 120 grit, 132 × 132 × 990 μm.
(B) 50% sol gel alumina 80 grit/50% 38A alumina 80 grit, abrasive grain obtained from Norton Company, Worcester, MA.

A productivity (rate of wheel production in the molding process per unit of time) increase of 5 times was observed for the mix of the invention relative to a conventional mix containing pore inducer. The invention mix exhibited free flow characteristics permitting automatic pressing operations. In the absence of pore inducer, the mix of the invention exhibited no springback after pressing and no coring during firing. The permeability of the wheels of the invention was 43 cc/second/inch water.

(II) Abrasive wheels comprising an equivalent volume percentage of open porosity were manufactured from the following mixes to compare the firing characteristics of mixes containing pore inducer to that of the invention mixes.

Wheel 10 Mix Formulations

| Ingredient | Percent by Weight (A) Invention | (B) Conventional |
|---|---|---|
| Abrasive grain* | 100 | 100 |
| Pore inducer (walnut shell) | 0 | 8.0 |
| Dextrin | 2.0 | 2.0 |
| Aroma Glue | 1.83 | 2.7 |
| Animal Glue | 4.1 | 5.75 |
| Ethylene glycol | 0 | 0.1 |
| Bulking agent (Vinsol ® powder) | 0 | 1.5 |
| Vitrified bonding agent | 26.27 | 26.27 |

*(A) 80 grit, 194 × 194 × 1360 μm.
(B) 50% sol gel alumina 36 grit/50% 38A alumina 36 grit, abrasive grain obtained from Norton Company, Worcester, MA.

The wheels of the invention showed no signs of slumpage, cracking or coring following firing. Prior to firing, the green, pressed wheels of the invention had a high permeability of 22 cc/second/inch water, compared to the green, pressed wheels made from a conventional mix containing pore inducer which was 5 cc/second/inch water. The high green permeability is believed to yield a high mass/heat transfer rate during firing, resulting in a higher heat rate capability for the wheels of the invention relative to conventional wheels. Firing of the wheels of the invention was completed in one-half of the time required for conventional wheels utilizing equivalent heat cycles. The permeability of the fired wheels of the invention was 45 cc/second/inch water.

EXAMPLE 5

This example demonstrates that high-porosity grinding wheels may be made by using pre-agglomerated grains. The pre-agglomerated grain was made by a controlled reduction in the extrusion rate during extrusion of an elongated grain particle, which caused agglomerates to form prior to drying the extruded grain.

High-porosity wheels were made as described in Example 1 from agglomerated and elongated TARGA™ grain without using any pore inducer (an average agglomerate had ~5–7 elongated grains, and the average dimension of each was ~194×194×(194×5.96) μm. The nominal aspect ratio was 5.96, and the LPD was 0.99 g/cc. The following Table 5 lists the mixing formulations. After molding and firing, vitrified grinding wheels were made with a porosity of 54%, by volume.

Wheel 11 Mix Formulation

| | Parts by Weight |
|---|---|
| Abrasive grain* | 100 |
| Pore inducer | 0 |
| Dextrin | 2.7 |
| Aroma Glue | 3.2 |
| Ethylene glycol | 2.2 |
| Vitrified bonding agent | 20.5 |

*(agglomerates of 80 grit, ~194 × 194 × 1160 μm)

EXAMPLE 6

This example describes the permeability measurement test and demonstrates that the permeability of abrasive articles can be increased greatly by using abrasive grains in the form of fibrous particles.

Permeability Test

A quantitative measurement of the openness of porous media by permeability testing, based on D'Arcy's Law governing the relationship between the flow rate and pressure on porous media, was used to evaluate wheels. A non-destructive testing apparatus was constructed. The apparatus consisted of an air supply, a flowmeter (to measure Q, the inlet air flow rate), a pressure gauge (to measure change in pressure at various wheel locations) and a nozzle connected to the air supply for directing the air flow against various surface locations on the wheel.

An air inlet pressure Po of 1.76 kg/cm$^2$ (25 psi), inlet air flow rate Qo of 14 m$^3$/hour (500 ft 3/hour) and a probing nozzle size of 2.2 cm were used in the test. Data points (8–16 per grinding wheel) (i.e., 4–8 per side) were taken to yield an accurate average.

Wheel Measurements

Table 6 shows the comparison of permeability values (Q/P, in cc/sec/inch of water) of various grinding wheels.

TABLE 6

Wheel Permeability

| Abrasive Wheel Sample | Porosity (Vol. %) | Permeability Q/P cc/sec/inch $H_2O$ Invention | Control |
|---|---|---|---|
| Example 1 | | | |
| (1) | 51 | 45 | 23 |
| (2) | 58 | 75 | 28 |
| (3) | 62 | 98 | 31 |
| Example 2 | | | |
| (4) | 77 | 225 | n/a |
| (5) | 80 | 280 | n/a |

TABLE 6-continued

| Wheel Permeability | | | |
|---|---|---|---|
| Abrasive Wheel | Porosity | Permeability Q/P cc/sec/inch $H_2O$ | |
| Sample | (Vol. %) | Invention | Control |
| Example 3 | | | |
| (6) | 54 | 71 | 30 |
| (7) | 54 | 74 | 30 |
| (8) | 58 | 106 | 34 |
| Example 4 | | | |
| (9) | 50 | 45 | 22 |
| (10) | 47 | 47 | 28 |
| Example 5 | | | |
| (11) | 54 | 43 | 25 |

Data was standardized by using wheels of at least one-half inch (1.27 cm) in thickness, typically one inch (2.54 cm) thick. It was not possible to make wheels to serve as controls for Example 2 because the mix could not be molded into the high porosity content of the wheels of the invention (achieved using elongated abrasive grain in an otherwise standard abrasive mix). The control wheels were made using a 50/50 volume percent mixture of a 4:1 aspect ratio sol gel alumina abrasive grain with a 1:1 aspect ratio sol gel or 38A alumina abrasive grain, all obtained from Norton Company, Worcester, Mass.

Wheel 11 comprised agglomerated elongated abrasive grain, therefore, the data does not lend itself to a direct comparison with non-agglomerated elongated grain particles nor to the permeability description provided by the equation: permeability=0.44×cross-sectional width of the abrasive grain. However, the permeability of the wheel of the invention compared very favorably to the control and was approximately equal to the predicted permeability for a wheel containing an otherwise equivalent type of non-agglomerated elongated grain.

The data show that the wheels made by the process of the invention have about 2–3 times higher permeability than conventional grinding wheels having the same porosity.

EXAMPLE 7

This example demonstrates how the L/D aspect ratio of abrasive grain changes the grinding performance in a creep feed grinding mode. A set of grinding wheels having 54% porosity and equal amounts of abrasive and bonding agent, made in a Norton Company manufacturing plant to a diameter of 50.8×2.54×20.32 cm (20×1×8 inch), were selected for testing, as shown in Table 7, below.

TABLE 7

| Properties differences among wheels | | | | |
|---|---|---|---|---|
| Grain[a] | Control Grain Mixture | Control Grain | Elongated Grain 1 | Elongated Grain 2 |
| (L/D) | 50% 4.2:1 50% 1:1 (vol) | 4.2:1 | 5.8:1 | 7.6:1 |
| Inducer Type | bubble alumina + walnut shell | Piccotac ® resin | none | none |

TABLE 7-continued

| Properties differences among wheels | | | | |
|---|---|---|---|---|
| Grain[a] | Control Grain Mixture | Control Grain | Elongated Grain 1 | Elongated Grain 2 |
| Air permeability (cc/sec/inch $H_2O$) | 19.5 | 37.6 | 50.3 | 55.1 |

[a]All grain was 120 grit seeded sol gel alumina grain obtained from Norton Company, Worcester, MA.

These wheels were tested for grinding performance. The grinding was carried out on blocks of 20.32×10.66×5.33 cm (8×4×2 inch) of 4340 steel (Rc 48–52) by a down-cut, non-continuous dress creep feed operation on a Blohm machine along the longest dimension of the blocks. The wheel speed was 30.5 meters/sec (6000 S.F.P.M.), the depth of cut was 0.318 cm (0.125 inch) and the table speed was from 19.05 cm/min (7.5 in/min) at an increment of 6.35 cm/min (2.5 inch/min) until workpiece burn. The grinding performance was greatly improved by using elongated Targa grains to make abrasive wheels having 54% porosity and an air permeability of at least about 50 cc/second/inch water. Table 8 summarizes the results of various grinding aspects. In addition to the benefits of interconnected porosity, the grinding productivity (characterized by metal removal rate) and grindability index (G-ratio divided by specific energy) are both a function of the aspect ratio of abrasive grain: the performance increases with increasing L/D.

TABLE 8

| Grinding differences among 4 wheels | | | | |
|---|---|---|---|---|
| Grinding Parameter | Control Grain Mixture | Control Grain | Elongated Grain 1 | Elongated Grain 2 |
| Maximum table speed without burn | 17.5 | 22.5 | 25 | 32.5 |
| G-ratio @15 in/min speed | 25.2 | 23.4 | 32.7 | 37.2 |
| G-ratio @25 in/min speed | burn | burn | 24.2 | 31.6 |
| Power @15 in/min speed (HP/in) | 22 | 20.8 | 18.8 | 15.7 |
| Power @25 in/min speed (HP/in) | burn | burn | 30.6 | 24.4 |
| Force $F_v$ @15 in/min speed (lbf/in) | 250 | 233 | 209 | 176 |
| Force $F_v$ @25 in/min speed (lbf/in) | burn | burn | 338 | 258 |
| Grindability Index @15 in/min speed | 2.12 | 2.08 | 3.23 | 4.42 |
| Grindability Index @25 in/min speed | burn | burn | 2.43 | 4.00 |

Speed in cm/minute is equal to 2.54×speed in in/min. Force in Kg/cm is equal to 5.59×force in lbf/in.

Similar grinding performance results were obtained for wheels containing 80 to 120 grit abrasive grain. For the smaller grit sizes, significant grinding improvements were observed for wheels having a permeability of at least about 40 cc/second/inch water.

I claim:

1. A method for making an abrasive article, comprising abrasive grain and bond in amounts effective for grinding; comprising the steps a) blending a mixture comprising abrasive grain consisting of a major amount of elongated abrasive grain having a length to cross-sectional width aspect ratio of at least 5:1 and vitrified bond to form an abrasive mix;

b) pressing the abrasive mix in a mold to form a green abrasive article having about 55% to about 80%, by volume, porosity; and c) firing the green abrasive article at 600° to 1300° C. for a firing time and under firing conditions effective to cure the green abrasive article and form the abrasive article, whereby relative to a firing time effective to cure an equivalent green abrasive article which does not contain the elongated abrasive grain under the firing conditions of step c), the firing time effective to cure the green abrasive article is reduced by at least one-half, and whereby the abrasive article has sufficient interconnected porosity to yield an air permeability capacity, measured in cc air/second/inch of water, of at least 0.44 times the cross-sectional width of the abrasive grain.

2. The method of claim 1, whereby the abrasive article following cure has less than 3%, by volume, variation in size relative to the green abrasive article, and the green abrasive article is substantially free of springback following pressing.

3. The method of claim 1 wherein the abrasive article, comprises 60 to 70% by volume porosity.

4. The method of claim 1, wherein the abrasive article comprises 3 to 15%, by volume, vitrified bond.

5. The method of claim 1 wherein the abrasive article, comprises 15 to 43%, by volume, of the elongated abrasive grain.

6. The method of claim 1, wherein the elongated abrasive grain has a length to diameter aspect ratio of at least 6:1.

7. The method of claim 1, wherein the abrasive article is substantially free of pore inducer materials.

8. The method of claim 1, wherein the abrasive mix further comprises materials selected from the group consisting of abrasive grain, filler, processing aids, combinations thereof, and agglomerates thereof.

9. The method of claim 1, wherein the elongated abrasive grain is sintered sol gel alpha alumina abrasive grain.

10. The method of claim 8, wherein the filler is selected from the group consisting of ceramic fiber, glass fiber, organic fiber, combinations thereof, and agglomerates thereof.

11. The method of claim 6, wherein the article has a permeability of at least 50 cc/second/inch of water for abrasive grain larger than 80 grit.

12. The method of claim 1, wherein the abrasive article is formed by firing the green abrasive article at a temperature of about 1100° to 1300° C. for about 1 to 5 hours.

13. The method of claim 9, wherein the abrasive article comprises about 16 to 34%, by volume, of the elongated abrasive grain.

14. The method of claim 1, wherein the abrasive article comprises of about 15 to 55%, by volume, of the elongated abrasive grain and about 5 to 20%, by volume, bond.

15. A method for making an abrasive article, comprising abrasive grain and bond in amounts effective for grinding; comprising the steps a) blending a mixture comprising abrasive grain consisting of a major amount of elongated abrasive grain having a length to cross-sectional width aspect ratio of at least 5:1 and vitrified bond to form an abrasive mix;

b) pressing the abrasive mix in a mold to form a green abrasive article having about 40% to less than 55%, by volume, porosity; and c) firing the green abrasive article at 600° to 1300° C. for a firing time and under firing conditions effective to cure the green abrasive article and form the abrasive article, whereby relative to a firing time effective to cure an equivalent green abrasive article which does not contain the elongated abrasive grain under the firing conditions of step c), the firing time effective to cure the green abrasive article is reduced by at least one-half, and whereby the abrasive article has sufficient interconnected porosity to yield an air permeability capacity, measured in cc air/second/inch of water, of at least 0.22 times the cross-sectional width of the abrasive grain.

16. The method of claim 15, whereby the abrasive article following cure has less than 3%, by volume, variation in size relative to the green abrasive article, and the green abrasive article is substantially free of springback following pressing.

17. The method of claim 15, wherein the abrasive article comprises 60 to 70% by volume, porosity.

18. The method of claim 15, wherein the abrasive article comprises 3 to 15% by volume, vitrified bond.

19. The method of claim 15, wherein the abrasive article comprises 15 to 43%, by volume, of the elongated abrasive grain.

20. The method of claim 15, wherein the elongated abrasive grain has a length to diameter aspect ratio of at least 6:1.

21. The method of claim 15, wherein the abrasive article is substantially free of pore inducer materials.

22. The method of claim 15, wherein the abrasive mix further comprises materials selected from the group consisting of abrasive grain, filler, processing aids, combinations thereof, and agglomerates thereof.

23. The method of claim 15, wherein the elongated abrasive grain is sintered sol gel alpha alumina abrasive grain.

24. The method of claim 22, wherein the filler is selected from the group consisting of ceramic fiber, glass fiber, organic fiber, combinations thereof, and agglomerates thereof.

25. The method of claim 20, wherein the article has a permeability of at least 50 cc/second/inch of water for abrasive grain larger than 80 grit.

26. The method of claim 13, wherein the abrasive article is formed by firing the green abrasive article at a temperature of about 1100° to 1300° C. for about 1 to 5 hours.

27. The method of claim 13, wherein the abrasive article comprises about 16 to 34%, by volume, of the elongated abrasive grain.

28. The method of claim 15, wherein the abrasive article comprises of about 15 to 55%, by volume, of the elongated abrasive grain and about 5 to 20%, by volume, bond.

* * * * *